US006983804B2

(12) United States Patent
Ellepola et al.

(10) Patent No.: US 6,983,804 B2
(45) Date of Patent: Jan. 10, 2006

(54) METHOD AND SYSTEM FOR GAS-LIFTING WELL EFFLUENTS

(75) Inventors: Jerome Hansabhaya Ellepola, Rijswijk (NL); Rene Victoire Adolf Oliemans, Bilthoven (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/275,208

(22) PCT Filed: May 4, 2001

(86) PCT No.: PCT/EP01/05124

§ 371 (c)(1),
(2), (4) Date: Feb. 27, 2003

(87) PCT Pub. No.: WO01/83944

PCT Pub. Date: Nov. 8, 2001

(65) Prior Publication Data

US 2003/0159820 A1 Aug. 28, 2003

(30) Foreign Application Priority Data

May 4, 2000 (EP) ..... 00303769

(51) Int. Cl.
*E21B 43/00* (2006.01)

(52) U.S. Cl. ..... 166/401; 166/309

(58) Field of Classification Search ..... 166/401, 166/402, 309

See application file for complete search history.

(56) References Cited

U.S. PATENT DOCUMENTS

| | | | | |
|---|---|---|---|---|
| 4,198,300 | A * | 4/1980 | Williams | 210/170 |
| 4,360,234 | A | 11/1982 | Hsueh et al. | |
| 4,446,917 | A | 5/1984 | Todd | |
| 5,314,525 | A * | 5/1994 | Eckert et al. | 75/583 |
| 5,562,161 | A | 10/1996 | Hisaw et al. | |
| 5,857,519 | A * | 1/1999 | Bowlin et al. | 166/105.6 |
| 6,318,464 | B1 * | 11/2001 | Mokrys | 166/252.1 |
| 6,568,477 | B1 * | 5/2003 | Dveyrin | 166/370 |

FOREIGN PATENT DOCUMENTS

WO 99 11905 3/1999

* cited by examiner

*Primary Examiner*—Frank S. Tsay

(57) ABSTRACT

A method and system for gas-lifting well effluents utilizes a porous wall in which an array of small lift-gas injection ports is present such that lift-gas is injected as an agglomerate of finely dispersed micro-bubbles into the stream of well effluents. In this way the lift-gas and produced crude oil form a froth and the risk of slugs of lift-gas that bypass slugs of crude oil and create an unstable flow regime is minimized.

8 Claims, 3 Drawing Sheets

METHOD AND SYSTEM FOR GAS-LIFTING WELL EFFLUENTS

FIELD OF THE INVENTION

The following invention relates to a use in connection with transport or flow through a production tubing string in a petroleum well of gas and liquid from a petroleum reservoir with low pressure, where the flowing fluid comprises a substantial liquid part and a less gas contribution, which gas mostly flows or bubbles past or through the liquid in the production tubing.

BACKGROUND OF THE INVENTION

In other words, it can be said that the present invention relates mainly to the type of petroleum wells which may be termed an oil producer, such oil producer producing mainly oil and some gas. This is different from petroleum wells (reservoirs) which are termed gas producer's, which gas producers often also produce some liquid, for example in the form of condensate and water. By such a liquid production (in a gas well) and low pressure in the reservoir, such a well could, however, gradually "drown", and the need for gas lift may be required. Thus, the present invention also relates to gas lift for gas wells.

Most petroleum producers (wells) will have a characterisation somewhat between these extremes (liquid with some gas-gas with some liquid), the liquid parts here being considered as having reasonably low viscosity.

When an oil producer (with some gas included) gradually looses its productivity by falling reservoir pressure (and lowest practical receiving pressure above ground), the pressure head in the production tubing will gradually balance the reservoir pressure. Production will then stop and the liquid level in the well will gradually come to rest below ground level.

Gas which is still released from the oil production tubing and in the zone close to the perforation, will bubble up through the production string, and then without effectively contributing to the reduction of pressure head.

It is in connection with this type of wells that the present invention has been developed.

By such oil producing wells also the residual gas will gradually be terminated, and in order to prevent such wells from "dying" it is common to introduce gas lift to reduce the pressure head resistance.

However, the present invention is to the fact of utilising the previously ineffective gas bubbles flowing through or bubbling past the liquid in a production tubing string, and then in surprising and new manner.

PRIOR ART

The invention will be described in more detail, by way of example with reference to the accompanying drawings, which show various embodiments of the dispersed lift-gas injection system according to the invention, which should not be construed as limiting the invention.

Further, there are known static mixing devices in a well from CA-C-13.00.002 and U.S. Pat. No. 4,832,127, but in these cases steam and water, respectively, is introduced in order to improve the well productivity.

COMPARISON WITH PRIOR ART

It is previously known from applicant's NO patent 146.826 to use static mixing elements in rising pipes, but then in connection with a different type of application, namely a typical petroleum platform riser pipe, in which slugging flow may occur. The static mixing elements are then mounted in order to even out or prevent the development of such flow slugging, and the used mixing elements must in this connection be regarded as energy damping or friction stimulating elements, which contributes in dampening the excessive or pulsing energy giving rise to said "slugging". In other words, the flow pattern is transferred from "slugging" to "mist flow" due to the changed hydraulic conditions introduced by the mixing elements.

In contrary to such a use in order to avoid "slugging", one has in connection with oil producing reservoir found that even if the mixing elements in their basic design are to be regarded as friction elements, they can surprisingly be used as liquid lifters for petroleum wells which produce substantially only liquid, which in turn is too heavy to lift itself.

Without such mixing elements the few gas bubbles which appear in the production tubing string, will only be greater and greater the further up they rise, which is to the fact that they become more and more ineffective as regards their lifting contribution. By using static mixing elements in that type of production reservoir which is the case here, it has surprisingly been found that the otherwise by-bubbling or through-bubbling gas will mechanically/hydraulically be finely distributed with such a fineness in the dominating liquid volume, that there is obtained a lower pressure head and thereby a stimulating lifting effect for the resulting liquid/gas-mixture. Consequently, according to the invention, there is given an instruction of how the gas bubble energy can be channelled or converted into an energy stimulating result.

Likewise, by introducing, according to the invention, a string of mixing elements in the production piping string, the need for gas lift will be reduced because there is achieved a lower mean pressure head, and then at a lower total gas flow rate. By only introducing a string having such mixing elements in a production well of the stated art, before said well is completely dead, it will thus be possible to increase the lifetime of the well until, sooner or later, it is necessary to introduce additional gas lift. For gas wells having low pressure and liquid production, wherein gas lift is installed, the requirement for lifting gas will also be reduced by the introduction of a string of mixing elements.

BRIEF DESCRIPTIONS OF THE INVENTION

The present invention is characterised by the use as stated in the attached patent claim 1.

In other words, there is given not only an instruction for a specific field of application, but also the unexpected utilisation of "useless" large bubbles in the form of distributed "small bubble carriers". This involves, as stated in the attached patent claim 2, that the liquid and the gas is given an effective mean density which in character tends towards a single-phase flow.

It is important to recognise in the present case, that the introduction of mixing elements in a production tubing, wherein productivity is good, will not contribute to a further improvement of the productivity, but rather a reduction due to the increased tall in pressure. Nevertheless, one has in connection with the present invention surprisingly found that the introduction of the mixing elements in a well at falling reservoir pressure, wherein the pressure head in the production tubing gradually evens out the reservoir pressure, will involve the exact opposite result, i.e. such "reduction elements" will operate in a completely opposite manner, namely to reduce the pressure head resistance and stimulate lifting effect for the liquid dominating liquid/gas-mixture.

Thus, especially when the production is unable to operate alone and the flow is low and the pressure head is low, the use of static mixing elements will give a positive stimulating effect by the distribution of gas in liquid.

Further features and advantages of the present invention will appear from the following description taken in conjunction with the appending drawings, as well as from the further attached patent claims.

DETAILED DESCRIPTION OF EMBODIMENTS

Figure 1:
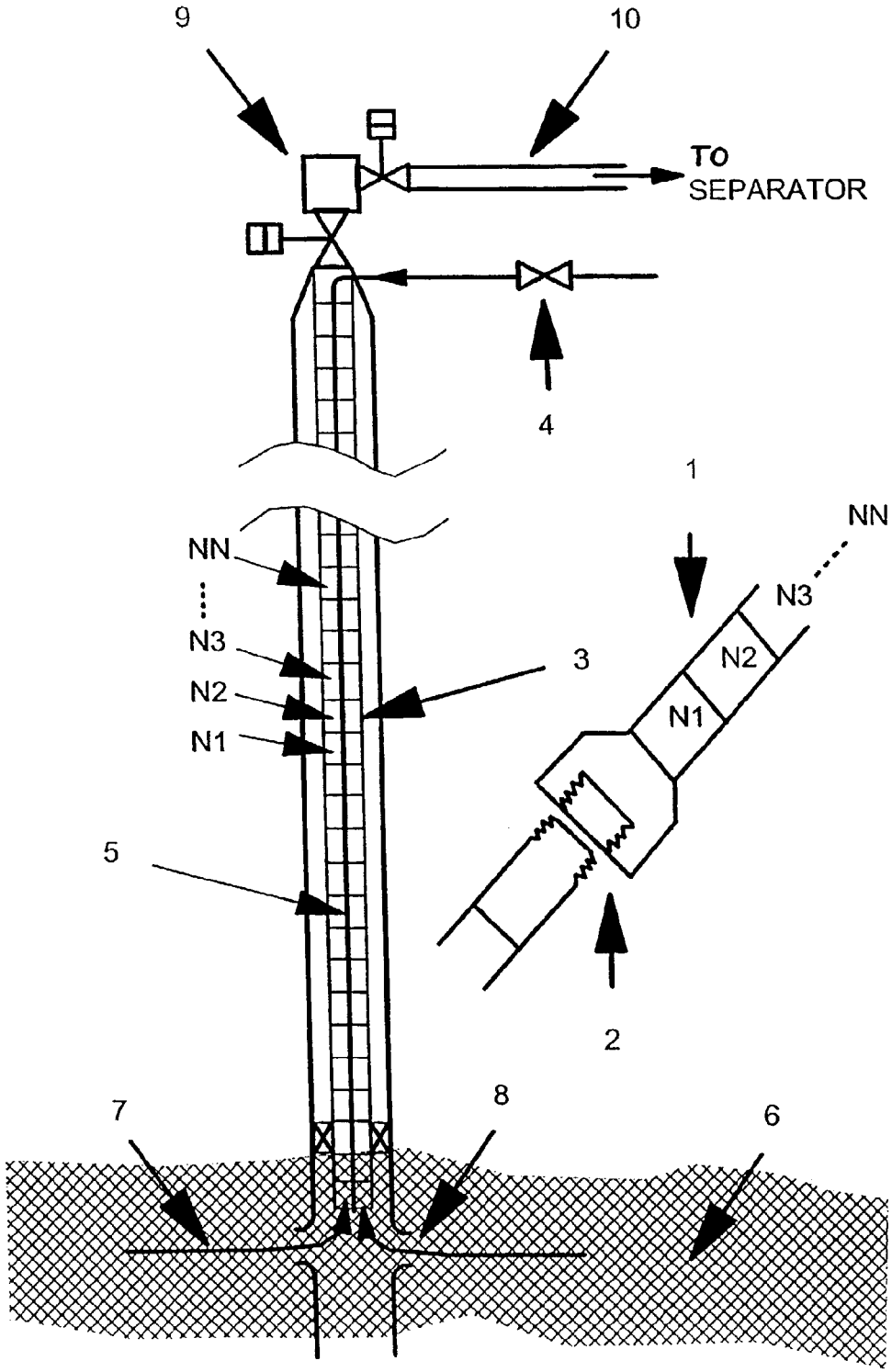
FIG. 1 is a schematical view illustrating the principle of the present invention, especially used in a production tubing string in a petroleum well, including an enlarged cut-out of the production tubing string.

The invention can be used in a petroleum well with a production tubing string as illustrated in the attached FIG. 1.

The object of the invention is to stimulate petroleum wells of the type as stated in the attached patent claim 1, and which has terminated—or almost terminated the production, by creating an optimum gas in liquid distribution and an optimum profile of the average gas/liquid density along the extent of the production tubing string. This in order to reduce the pressure head resistance at the bottom of the string as regards the flow of gas/liquid out of the reservoir.

The type of flow patterns which are found in typical production tubings in petroleum wells, is dependent upon gas/oil conditions and the pressure in the reservoir. The invention can be utilised in petroleum wells wherein the liquid portion is decreasing or terminates its flow by low reservoir head. By low head in the reservoir and a great contribution of liquid in the flow from the reservoir to the production tubing, it will be possible that the liquid flow in the production tubing is reduced or stopped because the pressure head of the flow has become relatively too large. This because the gas to a large degree flows or bubbles past the liquid in the production tubing. In other words, by an unfavourably mixed gas and liquid (gas bubbling through the liquid) the pressure head resistance will strive towards the liquid column. By mixing mechanically/hydraulically the liquid and the gas in the production tubing it is possible to achieve an effective average density and a correspondingly lower pressure head resistance. In other words, by a favourable mixture of gas and liquid the mixture will have a character of striving towards a single-phase having a mean density and correspondingly lower pressure head resistance. It is this effect which is to stimulate the well flow from oil reservoirs having low pressure.

The stimulation of dying wells, or wells having a low reservoir pressure, is currently being done by stimulating the reservoir itself in order to increase the pressure at the bottom of the production tubing or by devices in the production tubing which help the liquid upwardly in the production tubing. If the stimulation of the reservoir itself to increase the pressure at the bottom of the production tubing, is not practically possibly or effective, such devices in the production tubing helping the liquid upwardly in the production tubing, will normally represent the selected method. Methods having widespread application comprises various downhole pumping devices and gas lift systems.

The use in accordance with the invention is to the fact that static mixing elements, here specifically designated as N1-NN, are mounted in pipe lengths 1 of the overall or parts of the production tubing string 3, see the example in FIG. 1.

The elements N1-NN causes a mixing of the gas and the liquid phases, and then by means of a plurality of splittings and mergings along the extent of the pipe string. The use, which is here disclosed, is in principle not dependent upon a specific type of mixing elements, the use being substantially to the fact of improving the gas in liquid distribution and to create an optimum profile of the average gas/liquid density along the extent along the production tubing by the right choice of mixer "fineness".

In FIG. 1 it also appears that each tubing length of the production tubing string 3 appropriately can have mounted therein said static mixing elements N1-NN, which tubing lengths 1 appropriately can be screwed together through fittings 2 as a production tubing string 3 in the well in question.

Further, the embodiment of FIG. 1 illustrates that through the mounted mixing elements N1-NN there are provided a central guiding 5, to which guiding there via an appropriate upper valve 4, can be conducted possible gas for gas lifting. The guiding 5 can be made as a part of the mixing element connection.

In FIG. 1 there is also illustrated an oil zone, or an oil reservoir 6, from which gas and liquid 7 will flow through appropriate perforations 8 to said production tubing string 3 and upwards towards the well head 9, where gas and liquid via appropriate valves are passed on to a separator through a separator line 10.

It is previously known through Norwegian patent number 146.826, bearing the title "Method and equipment for evening out a rising multi-phase flow in slanting and vertical pipes", that static mixing elements can be mounted in rising pipes in order to level out, or prevent the creation of liquid "slugging". The use of the invention describe therein, should be a levelling out of the multiphase flow in rising pipes (platform risers) wherein the flow rate was given, and was too low to avoid "slugging". The previously known technique had not for its objection to create an increase in the total flow in the rising pipe.

A use of static mixing elements mounted in the overall or parts of petroleum production tubing, as this is suggested according to the present invention, thus represents a new application in relation to patent number 146.826, because the objection is now to increase the total flow in dying petroleum wells. Consequently, this novel application is primarily some sort of gas lift without introduction of gas.

However, it is to be understood that the invention can be used together with gas lift in order to reduce the need for lifting gas. This for those cases wherein a further increase of the production is wanted or possible.

Figure 2:
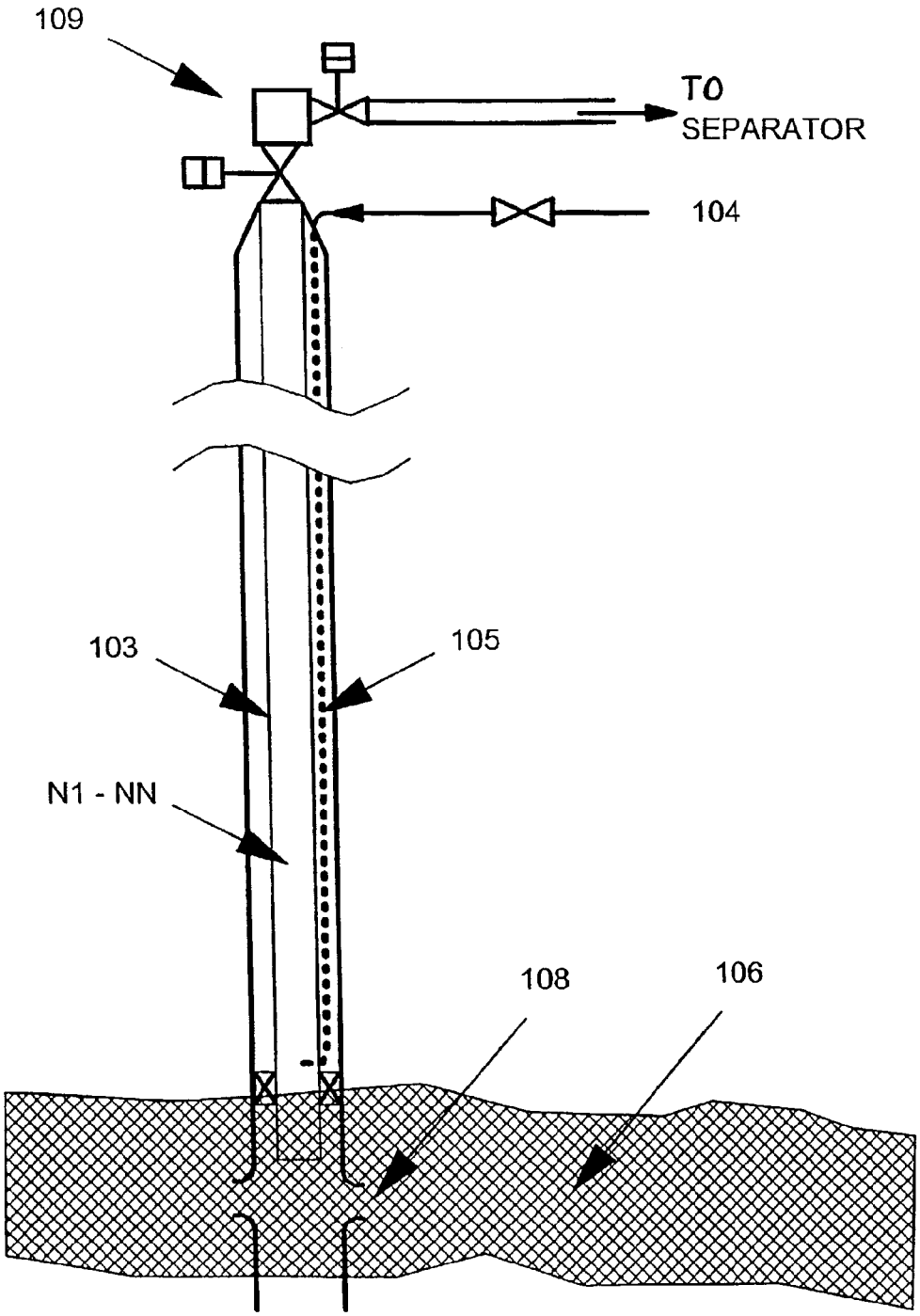
FIG. 2 is a schematical view illustrating a further embodiment of the invention.

In FIG. 2 there is illustrated a second example of a petroleum well, wherein the present invention can find its application, and wherein gas lift can also be used.

Possible lifting gas will here be supplied to the production tubing 103 via a tubing 105 which runs on the outside of the production tubing 103, said lifting gas being controlled by means of an appropriate upper valve 104.

The gas can appropriately be introduced in the production tubing 103 just above the perforations 108 towards the oil reservoir 106.

Figure 3:
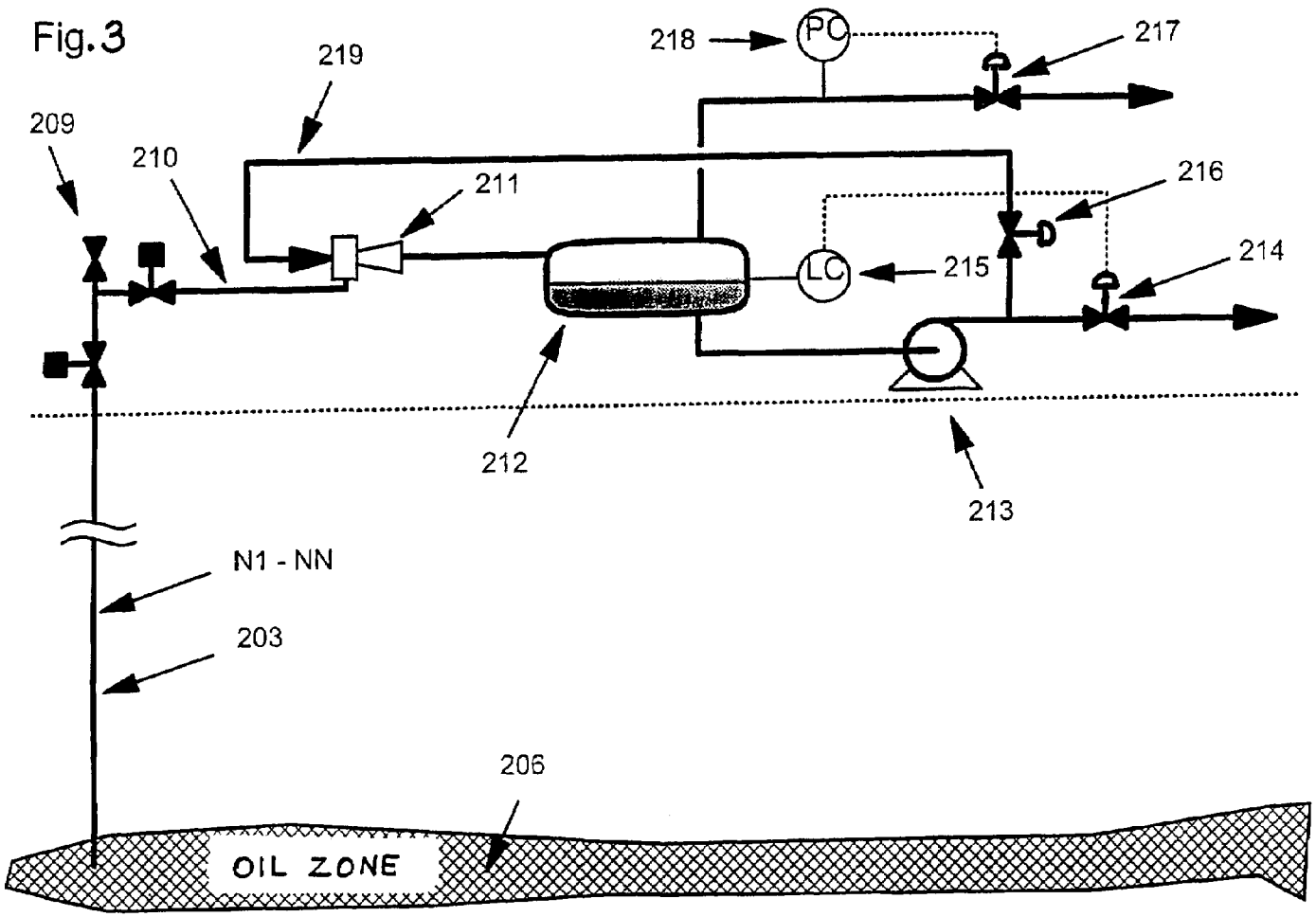
FIG. 3 is a schematical view illustrating the principle according to the invention applied in connection with further auxiliary devices.

FIG. 3 illustrates further example of the invention used in connection with further auxiliary devices.

Also here there is from an oil reservoir 206 supplied gas and liquid to the production tubing string 203 in a petroleum well, said gas and liquid being transported via the well head 209 to a separator line 210. By means of said auxiliary devices in FIG. 3 there will in the separator line 210 he created a moderate sub-pressure or vacuum, which together with the use of said discussed mixing elements N1-NN in connection with FIG. 1, will further contribute to the liquid lifting effect for petroleum wells given by the gas bubbles in the liquid containing little gas.

Even moderate vacuum will create a "Champagne" effect in the wells in question, which can be utilised to a maximum by the mixing elements N1-NN in order to reduce the pressure head resistance.

FIG. 3 illustrates also that said separator line 210 is connected with an ejector 211 which, in turn, is connected to a separator tank 212, wherein is created a small over-pressure. At the bottom of the separator tank 212 there is connected a pump 213 which from the tank 212 pumps out produced oil through an oil level valve 214, which, in turn, is connected with the tank 212 via an appropriate level meter 215.

Between the pump 213 and the oil level valve 214 there is via an ejector control valve 216 connected a feedback line 219 which, in turn, is connected to said ejector 211 for control of said moderate sub-pressure at the well head 209.

From the top of the separator tank 212 there will via a gas valve 217 be tapped off produced gas, under the surveillance of a pressure meter 218.

The invention claimed is:

1. A method for gas-lifting well effluents by injecting lift-gas downhole into the stream of well effluents in a wellbore, wherein the lift-gas is injected as an agglomerate of finely dispersed bubbles into the stream of well effluents thereby reducing the density of the well effluents in the wellbore.

2. The method of claim 1, wherein the lift-gas is injected into the stream of well effluents through a porous wall in which an array of lift-gas injection ports is present.

3. The method of claim 2, wherein the average width of said injection ports is less than 0.5 mm.

4. The method of claim 3, wherein the average width of said injection ports is less than 0.1 mm.

5. The method of claim 4, wherein said porous wall is formed by a porous membrane.

6. The method of claim 2, wherein the porous wall has a tubular shape and forms part of a tubular gas injection mandrel which is releasably inserted in a side pocket of a production tubing such that in use lift-gas is injected via an annular space surrounding the production tubing into the interior of the mandrel and then is ejected via the porous wall into the stream of well effluents in the production tubing.

7. The method of claim 1 wherein the lift-gas is injected as an agglomerate of finely dispersed bubbles into the stream of well effluents thereby reducing the bottom hole pressure in the wellbore.

8. A system for gas-lifting of well effluents, the system comprising a porous wall in which an array of lift-gas injection ports is present, through which ports in-use lift-gas is injected as an agglomerate of finely dispersed bubbles into the stream of well effluents.

* * * * *